United States Patent [19]

Hawkins et al.

[11] Patent Number: 4,480,347

[45] Date of Patent: Nov. 6, 1984

[54] PILLOW SHAM

[75] Inventors: Jeanette C. Hawkins, Stoneville; Nancy W. Sella, Mebane; Carl D. Bradford, Eden, all of N.C.

[73] Assignee: Fieldcrest Mills, Inc., Eden, N.C.

[21] Appl. No.: 428,159

[22] Filed: Sep. 29, 1982

[51] Int. Cl.[3] ..... A47G 9/00

[52] U.S. Cl. ..... 5/490; 5/491

[58] Field of Search ..... 5/490, 491, 492, 434, 5/436; D6/201, 202, 203, 204

[56] References Cited

U.S. PATENT DOCUMENTS

| | | | |
|---|---|---|---|
| D. 149,626 | 5/1948 | Fielding | 6/201 |
| 1,469,523 | 10/1923 | McGarvey | 5/490 |
| 1,871,003 | 8/1932 | Longletz et al. | 5/490 |
| 2,956,291 | 10/1960 | Hauptman | 5/434 |
| 4,312,087 | 1/1982 | DeGeus | 5/490 |

*Primary Examiner*—Alexander Grosz
*Assistant Examiner*—Vinh Luong
*Attorney, Agent, or Firm*—Bell, Seltzer, Park & Gibson

[57] ABSTRACT

A pillow sham includes a front panel and an endless skirt attached to the perimeter of the panel. The skirt is gathered throughout to provide a decorative effect and defines a pillow-receiving pocket suited to accommodate a range of pillow sizes.

1 Claim, 7 Drawing Figures

PILLOW SHAM

BACKGROUND OF THE INVENTION

1. Field of the Invention

The present invention relates to pillow covers and, more particularly, to pillow shams.

2. Description of the Prior Art

Pillow shams have long been used to cover and provide a decorative appearance to pillows during the day, the shams being placed over the pillows in the morning and removed at night.

A common pillow sham in widespread use today generally has a rectangular shape and is formed from textile sheet material having opposed front and rear panels, with the rear panel being provided with a transverse opening for insertion and removal of a pillow. Such shams are often provided with borders, such as ruffles, to enhance the decorative appearance.

Another type of pillow sham of the prior art is formed from a central front panel and underlying strips joined to the perimetric edges of the front panel to define a rear pocket into which a pillow may be inserted. Such a pillow sham is illustrated and described in U.S. Pat. No. 1,042,439.

One disadvantage of the described pillow shams is that they have no elasticity to conform them closely to varying sizes in pillows. Furthermore, the decorative aspect of such pillow shams is limited to the choice of fabric design and the nature of any border.

SUMMARY OF THE INVENTION

The present invention provides a novel pillow sham that retains the desirable features of conventional pillow shams, while enhancing the sham in both appearance and utility. More particularly, in accordance with the present invention, a pillow sham is provided with a front panel formed from a material providing the desired decorative effect. A skirt of gathered material is joined to the perimeter of the front panel and forms a pillow-receiving pocket sized to accommodate a range of pillow sizes.

In accordance with the present invention, there is provided a pillow sham that comprises a front panel and an endless skirt joining the front panel along the perimeter of the front panel to define a pocket for receiving a pillow. The skirt is formed from sheet material and has a free edge defining the opening for access to the pocket. An elastic strip is secured to the skirt along the free edge so as to effect a gathering therealong. The skirt sheet material adjacent the perimeter of the front panel is also gathered. The gathering or skirt sheet material at both the free edge and adjacent the front panel serves to present an overall gathered appearance to the skirt. The elastic strip at the free edge facilitates insertion and removal of the pillow from the pocket.

In a particular embodiment of the invention, the skirt is formed from sheet material separate from the front panel and the attachment of the skirt to the front panel is such as to effect a gathering along the line of attachment.

The gathered appearance of the skirt may be enhanced by securing a second elastic strip intermediate the skirt free edge and the front panel.

BRIEF DESCRIPTION OF THE DRAWINGS

Some of the features of the invention having been stated, others will appear as the description proceeds when taken in connection with the accompanying drawings in which—

DETAILED DESCRIPTION

While the present invention will be described hereinafter with particular reference to the accompanying drawings, it is to be understood at the outset of the description which follows that it is contemplated that the present invention may be varied in specific detail while still achieving the desirable characteristics and features of the present invention. Accordingly, the description is to be understood as a broad enabling teaching directed to persons skilled in the applicable arts, and is not to be understood as restrictive.

Figure 2:
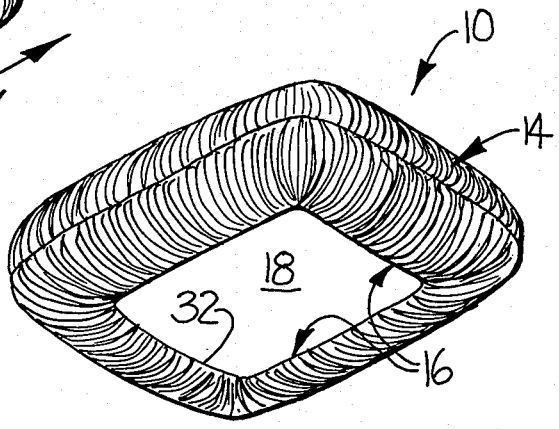
FIG. 2 is a rear perspective view of the pillow sham of FIG. 1, also shown in place over a pillow.
Figure 3:
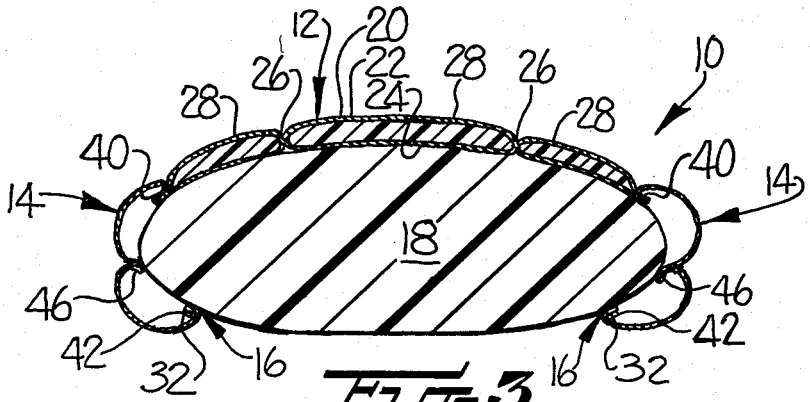
FIG. 3 is a sectional view taken substantially along line 3—3 of FIG. 1.
Figure 4:
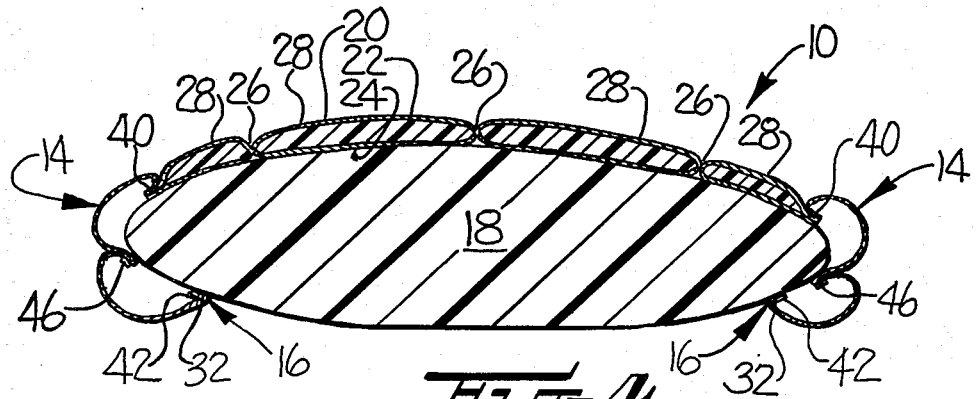
FIG. 4 is a sectional view taken substantially along line 4—4 of FIG. 1.

Referring to the drawings, there is shown a pillow sham 10 contructed in accordance with the present invention. Sham 10 includes a front panel 12 and a skirt 14 formed from sheet material. As best shown in FIG. 2, sham 10 includes a pocket 16 for holding a pillow 18 within the sham.

In the illustrated embodiment front panel 12 is substantially rectangular and is sized to accommodate a suitable range of pillow sizes that may be conveniently covered by sham 10. The illustrated front panel 12 comprises multiple thicknesses of material and, in specific form, is a quilted panel including facing fabric 20, batting 22 or fibrous filler material, and backing fabric 24 joined together in conventional fashion by stitches 26 to define a plurality of rectangular quilt portions 28.

Figure 7:
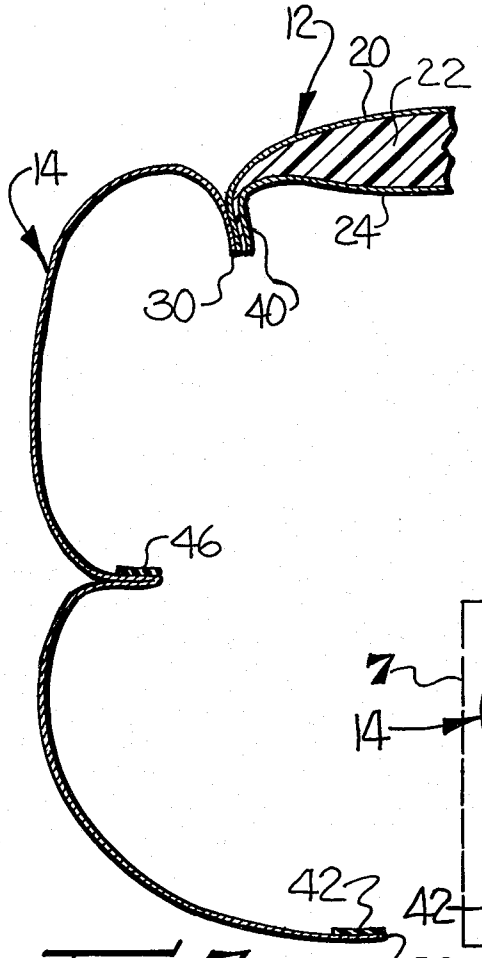
FIG. 7 is a further enlarged view of the portion of FIG. 6 enclosed within the broken lines 7.

Skirt 14 is an endless skirt joining front panel 12 along the perimeter of the front panel. Skirt 14 has an inner peripheral edge 30 (FIG. 7), and free edge 32 defining the opening for access to pocket 16. In the illustrated embodiment, skirt 14 is formed from sheet material separate from front panel 12, with the material adjacent the inner peripheral edge 30 of the skirt being attached to the perimeter of the front panel 12. As best illustrated in FIG. 7, the perimeter portions of facing fabric 20, batting 22, and backing fabric 24, and the material adjacent skirt edge 30, are sewn together at a seam 40. The skirt sheet material at seam 40 is gathered by the sewing operation.

Figure 1:
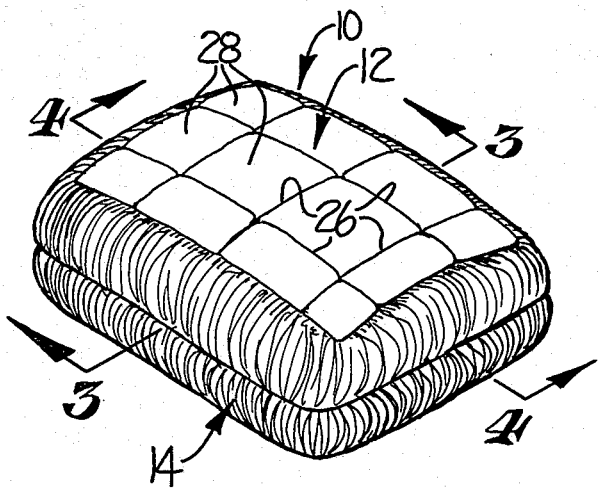
FIG. 1 is a front perspective view of a pillow sham of the invention, with the sham being shown in place over a pillow.
Figure 5:
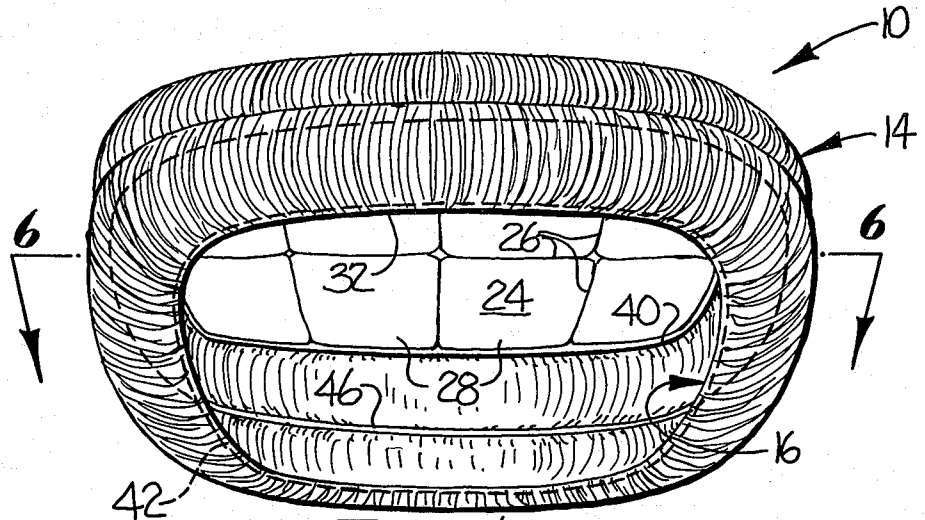
FIG. 5 is an enlarged rear perspective view of the sham of FIGS. 1 and 2, but showing the sham standing alone without an inserted pillow.
Figure 6:
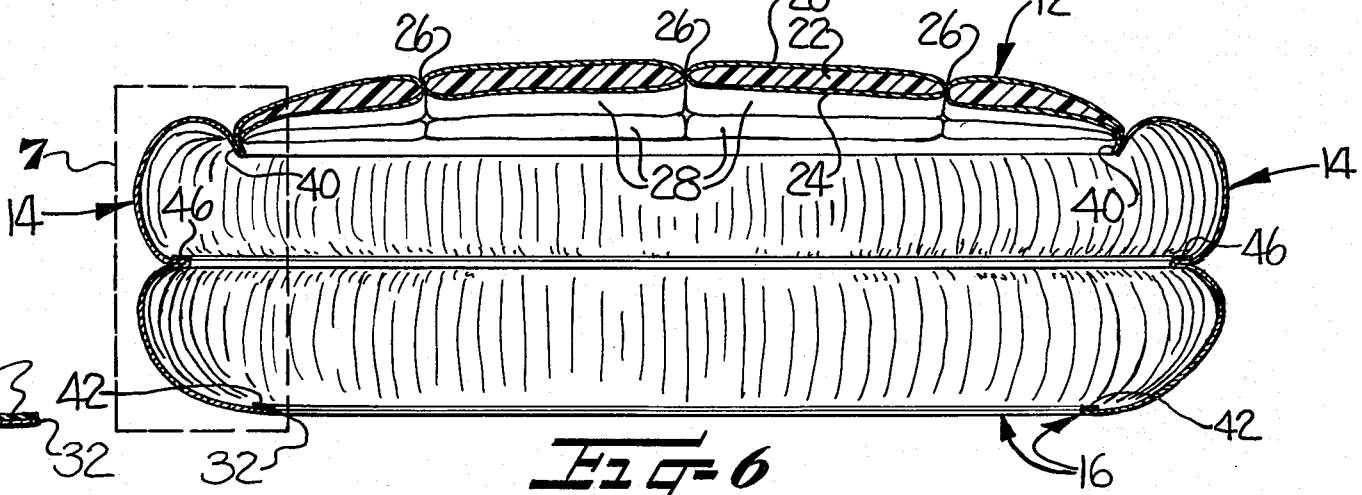
FIG. 6 is a sectional view on a further enlarged scale taken substantially along line 6—6 of FIG. 5.

Elastic strip means in the form of an elastic strip 42 is secured to the sheet material along free edge 32 with the elastic in a stretched state, thereby gathering the adjacent material when the elastic relaxes. The gathering of the skirt sheet material adjacent the perimeter of front panel 12 and along skirt free edge 32 serves to present an overall gathered appearance to the skirt, as clearly shown in FIGS. 1, 2 and 5.

In the illustrated embodiment a supplemental gathering of material intermediate the skirt free edge 32 and the perimeter of front panel 12 is provided. As best shown in FIG. 7, this intermediate gathering is achieved by second elastic strip means in the form of an elastic strip 46 sewn to a doubled-over intermediate portion of skirt 14. The intermediate gathering serves to further enhance the gathered appearance of the skirt beyond that achieved by seam 40 and elastic strip 42.

It will be appreciated that the resiliency of the sheet material at free edge 32, provided by elastic strip 42, facilitates insertion and removal of pillow 18 with respect to pocket 16. Thus, it can be seen that the present invention provides a sham that is enhanced in utility, in addition to the mentioned enhancement in appearance provided by the gathered effect of the skirt and the decorative appearance of the front panel.

In a particular form of the illustrated embodiment, a versatile sham adapted for use with a wide range of conventional pillow sizes was provided with a front panel approximately 15 inches wide by 20 inches long and a skirt approximately 12 inches wide, with the skirt having an initial length of 105 inches prior to being gathered and attached to the front panel. The skirt gathering was at a ratio of 1.5 inches of material to 1 inch of finished seam at seam 40, and at elastic strips 42 and 46 (with each elastic strip having a length in the relaxed state of approximately 70 inches).

While the present invention has been described with reference to a preferred embodiment, it will be appreciated that modifications may be made without departing from the spirit of the invention. For example, the front panel may be formed from panel materials other than quilting to provide the desired decorative effect. This and other modifications are within the true spirit and scope of the invention.

That which is claimed is:

1. A pillow sham comprising;

a front panel having facing and backing layers of fabric and batting therebetween, and stitching interconnecting said facing and backing layers of fabric so as to present a quilted appearance to the front panel;

an endless skirt connected to said front panel along the entire perimeter of the panel and cooperating therewith to define a pocket on one side of said panel adapted to removably receive a pillow therein;

said skirt being formed from sheet material and having a free edge defining an opening behind said front panel for access to the pocket;

elastic strip means secured to said skirt sheet material along the free edge thereof so as to effect a gathering of the skirt sheet material therealong;

second elastic strip means secured to the skirt sheet material intermediate the skirt free edge and front panel and extending therearound, said second elastic strip means serving to effect an intermediate gathering of the skirt sheet material; and the sheet material of said skirt adjacent the perimeter of said front panel also being gathered, whereby the gathering of sheet material along the skirt free edge, and intermediate the skirt free edge and the front panel, and adjacent the perimeter of the front panel present an overall gathered appearance to the skirt.

* * * * *